United States Patent [19]

Goodman

[11] 4,029,342

[45] June 14, 1977

[54] INTEGRATED RECORD CONTROL SYSTEM AND METHOD

[76] Inventor: Sidney R. Goodman, 24161 Greenlawn Ave., Beachwood, Ohio 44122

[22] Filed: Mar. 26, 1975

[21] Appl. No.: 562,095

[52] U.S. Cl. ..... 282/29 B; 282/7

[51] Int. Cl.[2] ..... B41L 1/02

[58] Field of Search ..... 235/61.12 N; 282/29 B, 282/7

[56] References Cited

UNITED STATES PATENTS

| | | | |
|---|---|---|---|
| 2,435,684 | 2/1948 | Jones | 282/29 B |
| 2,647,765 | 8/1953 | Brechner | 282/29 B |
| 2,747,895 | 5/1956 | Hall | 282/29 B |
| 3,184,255 | 5/1965 | Rohde | 282/29 B |
| 3,533,647 | 10/1970 | Somerville | 282/29 B |

*Primary Examiner*—Jay P. Lucas

*Attorney, Agent, or Firm*—Teare, Teare & Sammon

[57] ABSTRACT

An integrated system for combined manual and computerized record control including a base-like correlation device adapted for detachably mounting overlay and primary and secondary data storage members for selectively and automatically registering informational input data for permanent record keeping and for feedback into a computerized system for providing current output informational data for recording into the system for accurate and current record control.

7 Claims, 10 Drawing Figures

INTEGRATED RECORD CONTROL SYSTEM AND METHOD

BACKGROUND OF THE INVENTION

The present invention relates to a record control system, and more particularly relates to an integrated system for the automatic and computerized record control of informational data. The present invention has particular application, for example, such as in effective real estate property control in recording periodic (e.g., daily, monthly, etc.) transactions, such as in the handling of security deposits, rent payments, miscellaneous income, credits, or the like.

In one form of property management, a central record keeping facility provides information on a regular periodic basis, such as monthly, to the manager of a particular building or group of buildings. The information would include, for example, a particular suite number, and tenant's name, the base rent and any extras. The on location property manager uses this information to assist him in determining what the central records, as of the last period, indicate as to what a tenant's payments should be. He then usually records the monies received on a permanent storage member, such as a tenant ledger for each tenant. He also records the amounts received on the deposit ticket. Each deposit ticket would contain for that day the amounts received from a plurality of tenants. The amounts actually received may not correspond to the amounts which the information from the central system indicated were due. Moreover, a change in conditions since the last period may have occurred, such as, for example, the tenant has a deduction for repairs or has decided to take a garage. It is necessary for the manager to indicate such changes to the central office so that the changes can be made on the next information sheet for the next period and on the separate computerized printout of the actual transactions of the manager for the period of the operation, as well as, make separate entries of such amounts on the tenant ledger and deposit ticket for depositing the funds in the bank. It can be seen that due to the number of entries, and the changing nature thereof, there is a great chance for error both by the property manager and by the person updating the central records.

SUMMARY OF THE INVENTION

An integrated system for automatic and computerized record control and method; the system comprising a base member adapted to receive overlays in a partially selective, partially predetermined spatial orientation, a secondary data storage member adapted for detachably mounting on said base member, a primary data storage member adapted to be detachably mounted on said base member in at least a partially overlying relation in respect to said secondary storage member, and an overlay member adapted to be detachably mounted on said base member in overlying relation in respect to said primary data storage member, said members having novel and correlated means for providing partially selective and partially predetermined orientation relative to said orientation means and to each other and cooperating with transfer means for simultaneously and accurately transferring informational data in a predetermined specially correlated relation onto said primary and secondary storage members while providing input for accurate updating of the computer for the next period and for a separate computerized record of the actual transactions as recorded on the primary and secondary data storage members.

From the accompanying description and drawings, it will be seen that the system and method of the present invention provides an integrated system for accurate and timely information retrieval, modification, use and recordation, while at the same time providing a more accurate means for updating the computer. The present invention has particular advantages in real estate management, such as in apartment management control, or the like, which is constructed and arranged for full computerized application. The system method of the invention is extremely comprehensive and flexible so as to be suited to a variety of problems in respect to a given record keeping control system. Further, the system and method of the present invention provides relatively simplified input requirements so as to reduce clerical time, thereby requiring far fewer man hours per unit managed. It also provides for an increase in accuracy in an extremely complex area, despite a concurrent increase in recording speed.

DESCRIPTION OF THE PREFERRED EMBODIMENTS

Figure 1:
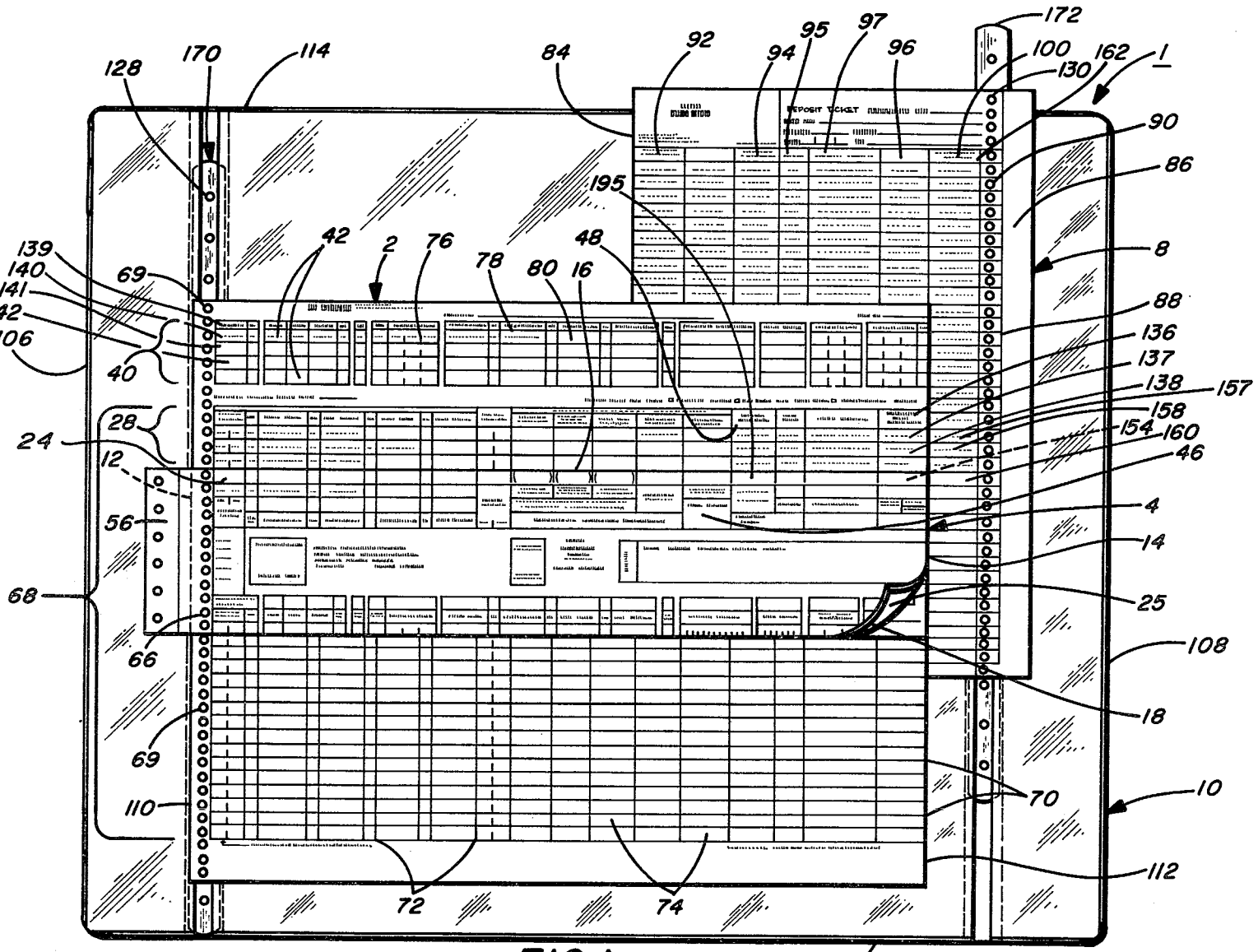
FIG. 1 is a top plan view illustrating a portion of the integrated system of the present invention.

Referring again to the drawings, and in particular to FIG. 1, there is disclosed the closed-loop system, designated generally at 1, in accordance with the present invention for the provision of accurate recordation use and storage of computer print-out material in conjunction with a novel structural and functional arrangement for recording the information and providing an accurate updating of informational data for maintaining the computer and the records current. Briefly, in one application of the present invention, a rental agent of an apartment house, for example, may receive from a centralized computer system informational data, such as the rents, rent changes, other financial modifications, or the like, in relation to each rental apartment unit based upon similar informational data received as a feedback from the closed-loop system of a prior recording period, such as the prior month, for example.

By the present system, the on-location property manager uses the information from the last period as his starting point for determining the amount of money due. He allows for changes of which he has knowledge which have occurred since the last period, such as the tenant requesting an extra service such as a garage. He then makes his entries, including the changes, in accordance with the novel structural system, to provide an accurate but rapid recordation of the events for permanent record keeping, for use in recording the deposits in that day of a plurality of tenants, and for an aid in updating of the computer for the next period for transmittal to the manager, and for a computerized report of the transactions entered by the manager on his records.

In general, the system 1, in the embodiment shown includes a primary data storage member 2 in the form of a tenant ledger card, a computer print-out overlay member 4 in the form of a rental notice sheet adapted to be disposed in detachable overlying relation in respect to the primary data storage member 2. The members 2 and 4 are structurally and functionally arranged for informational correlation so as to automatically transfer printed data from the overlay member 4 to the data storage member 2, and to receive informational data for input to a computer (not shown) for computerized processing. In the form shown, a secondary data storage member 8, in the form of a deposit ticket sheet, applicable to a plurality of primary data storage members, is adapted to be disposed in underlying relation in respect to the primary data storage member 2 so as to receive a given portion of informational data from the overlay member 4. A spatial correlation member 10, or base, in the form of a peg board device, is provided to provide an adjustable and predetermined spatial correlation between the data storage members 2 and 8 in relation to the overlay member 4 for the transfer of informational data for computerized record keeping, as will hereinafter be more fully described.

In accordance with the invention, the overlay member 4 is preferably of a polygonal, such as rectangular-shaped, configuration defined by oppositely disposed side edges 12 and 14 and oppositely disposed upper 16 and lower 18 outer end edges which define the construction shown. Preferably, the member 4 is of a single thickness construction.

Figure 2:
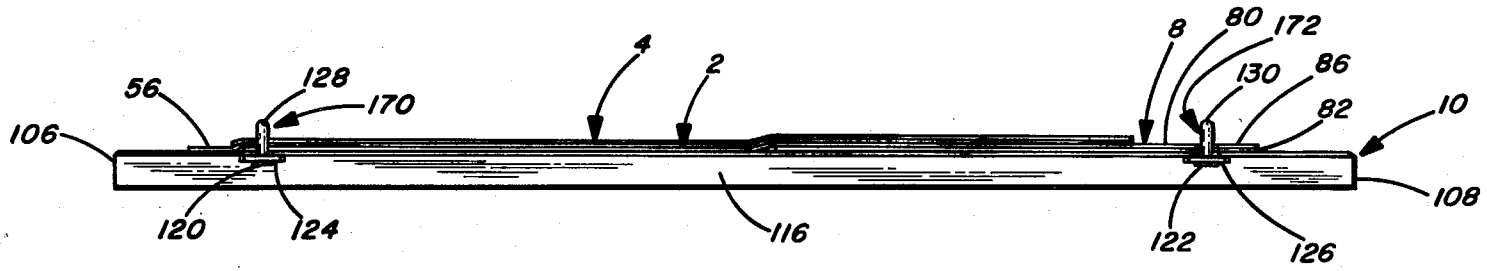
FIG. 2 is a front elevation view looking from the bottom of FIG. 1.
Figure 3:
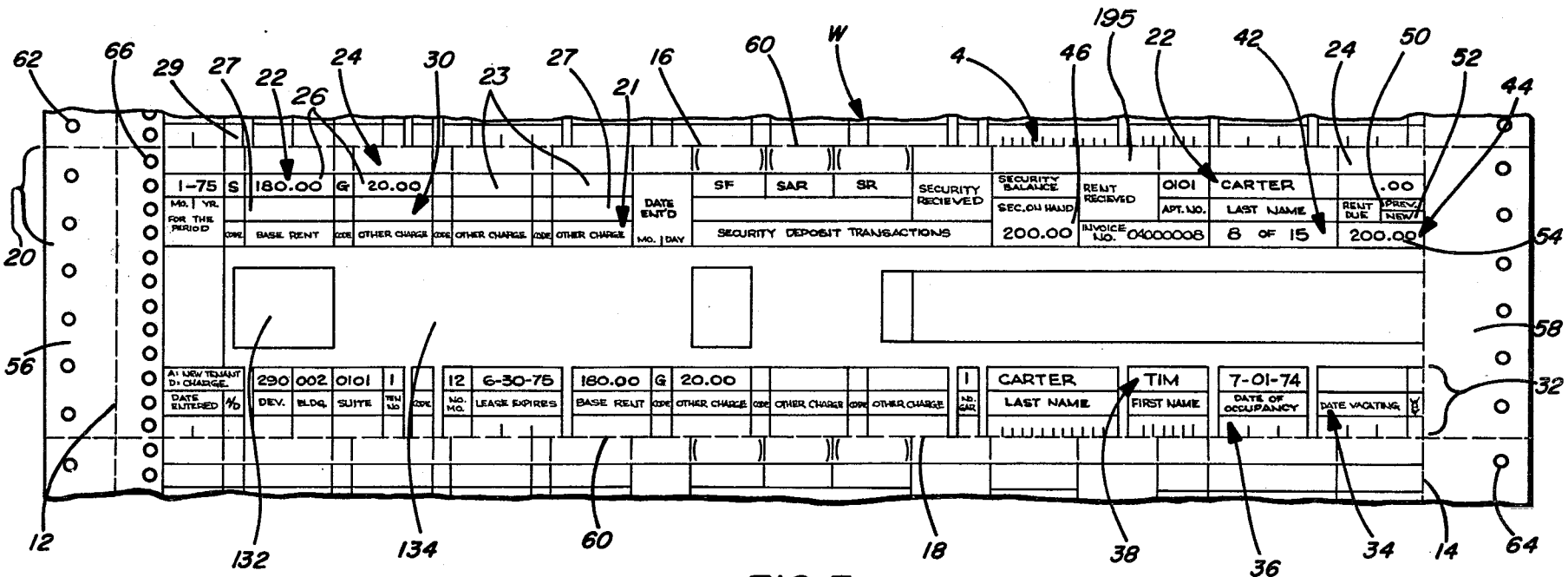
FIG. 3 is an enlarged, fragmentary top plan view illustrating one of the overlay members of the present invention in relation to fragmentary portions of other overlay members provided in the form of a web for computerized print-out in accordance with the invention.

As best seen in FIG. 3, the overlay member 4 includes a first set 20 of informational data blocks disposed adjacent the upper edge 16 thereof. In the form shown, the sets 20 include an intermediate horizontal row 22 of spatially predetermined computer print-out information and an outermost upper horizontal row 24 of spatially correlated recording blocks. Preferably, the rows 22 on the back side, as at 25, FIG. 2, of the overlay member 4, are provided with transfer means, for example such transfer means could be a carbonless transfer media, such as so-called NCR paper, a trademark of the National Cash Register Company, for transcribing on the upper row 24, for transcribing print-out information and/or changes from the overlay member 4 automatically onto spatially correlated rows of horizontally extending rows of blocks, such as at 28, on the primary data storage member 2, as best seen in FIG. 1.

In this form, the member 4 includes a lower horizontally extending row 30 of blocks disposed in vertical alignment with respect to the blocks on the row 22 of the overlay 4 for use in connection with updating the computer as to the actual transactions occurring in the period of the overlay 4 for use subsequently in a computer print-out of the actual transactions. The overlay member 4 includes another set 32 of horizontally spaced blocks adjacent the lower edge 18. The set 32 includes intermediate 34, lower outermost 36 and inner 38 horizontally extending block rows with the outermost lower row 36 being left blank as in the case of upper row 24 and having transfer media, such as heretofore described, for transferring relatively less informational data to the primary data member 2 indicative of current information of the period to be repeated at least in the next period, and to provide input to the computer for the next period. For example, the lower block set 32 may be correlated with another block set 40 (FIG. 1) on the primary member 2 by registering the lower blank row 36 so that it overlies a corresponding one of a plurality of horizontally extending rows, as at 42, in the block set 40 for recording changes which will appear in the overlay of the next period. Conversely, when a transaction for the period of the overlay is to be made, the transcription is made on the outermost upper row 24 in relation to the block set 28 on the primary data member 2.

In one aspect of the invention, the print-out information, in the form of printed information indicia units, such as the amount of "base rent", i.e. $180.00, or the amount of charge", i.e. $20.00, is placed on certain blocks 26 of the intermediate row 22. The blocks 27 of the lower row 30 are transcribed upon whenever the transcription on the outermost upper row 24 is not exactly the same as the computer-printed indicia in intermediate row 22. For example, the difference is transcribed in respect to rows 22 and 24 on row 30 via blocks 27. This information is used as input to the computer in producing the print-out report of the actual transactions of the period of the overlay member 4.

As best seen in FIG. 3, the outermost upper row 24, which is left in blank, extends the full length of the overlay member 4, with portions thereof used for correlation with preprinted and previously computerized data on the intermediate row 22. As explained later, the columns on such row, being vertically aligned above the intermediate row 22, provide for accurate transcription when there is no change in the information needed, and a location for placing changed information. In either event, such information is automatically entered for permanent recording on the tenant ledger 2 and as a step in the input to the computer for its print-out of the actual transactions.

As illustrated in FIG. 3, the overlay members 4 are initially provided from an elongated web W of intermediate length in the form of a computer print-out sheet. The web W has oppositely disposed longitudinally extending tear-off strips 56 and 58 disposed adjacent the end edges 12 and 14 of the overlay member 4 for separation therefrom at the joining edges as at 12 and 14, which may be of the conventional perforated type, for example. Hence, the web W comprises a plurality of severably attached, as at 60, overlay members 4 for continuous computerized printing of current informational data thereon. For movement of the web through the computer (not shown), the edge strips 56 and 58 are provided with corresponding longitudinally spaced tractor apertures 62 and 64 to enable the web W to be drawn through a conventional type computer (not shown) so that stored informational data particularly applicable to each overlay member 4 may be up dated on a predetermined basis (e.g., daily, weekly, monthly, or the like) for record keeping purposes.

In addition to the apertures 62 and 64 for computerized tractive operation, each of the respective overlay members 4 includes a plurality 66 of lengthwise spaced apertures 66 disposed in alignment and generally parallel to the outer edge 12 thereof. As shown, the apertures 66 are of a predetermined size and spaced in predetermined relationship from one another by approximately one-fourth inch so as to correspond in aligned relation with the outermost row 24 of blocks on the overlay member 4. The outermost row 24 is of a greater vertical height than the diameter of the apertures 66, and the spacing between the apertures 66 is also less than the vertical height of rows 24 and 36. Preferably, the center-lines of the apertures 66 are disposed substantially at the mid-point of each of the respective block rows on the overlay member 4. By this arrangement, there is provided an automatic alignment of the respective block rows in a predetermined relationship in relation to the overlay, primary and secondary data recording and/or storage members.

In general, therefore, it will be seen that portions of the intermediate row 22 contain the computer print-out data on the overlay member 4 in accordance with the closed-loop computerized system. The outermost upper row 24 is provided in a blank form so that the print-out informational data from the intermediate row 22 and/or any changes thereon can be recorded thereon for transfer to the primary storage member 2 in accordance with one aspect of the present invention. Hence the outermost upper row 24 being provided in-blank affords an indication of changes in the print-out information from the computer which is made at the time of recordation of a given transaction. Accordingly, any newly changed information recorded on the outermost row 24 immediately above the intermediate row 22 is automatically transferred to the corresponding underlying row of the lower section 68 on the primary storage member 2. Then, the fact that changes were made and the nature of the changes is reflected on the lower row 30 (FIG. 3) for use as input for updating the computer at the end of a given cycle (e.g., the month date appearing in column 176 row 22 (FIG. 5) to indicate the actual transactions that occurred in such period.

It is to be understood, that the overlay 4 may contain other identification information, such as the name of the building, the number of the suite or the like, printed thereon by the computer at other locations, such as at 132 and 134, when desired.

In accordance with the invention, the primary data storage member 2, such as a tenant ledger card, is of a single thickness sheet construction of polygonal, such as rectangular-shaped construction, adapted to provide a record of all transactions, such as relating to a given tenant. For example, the members 2 are filed in a particular numbered sequency (e.g., by suite number). As best seen in FIG. 1, the member 2 has the block set 40 which has a relatively reduced vertical dimension in relation to a lower block section 68 (FIG. 1) which comprises the remainder of the member 2. Hence, the upper block section 40 may be employed for changes in the informational data to appear on the next month's overlay member, whereas, the lower section 68 may be employed for recording the transaction for each month. This member 2 includes a plurality of laterally spaced apertures 69 having the same vertical spacement as the apertures 66 in the overlay member 4. In the form shown, the lower block section 68 includes a plurality of horizontally extending oppositely disposed parallel lines 70 (FIG. 1) in conjunction with a plurality of predetermined vertically spaced lines 72 which divide the lower section into a plurality of vertically extending and laterally spaced columns, as at 74, for registration with corresponding columns on the overlay member 4. Here again, the apertures 69 are preferably in alignment with the horizontal rows defined by the lines 70 and in matching correlation with the apertures 66 in the overlay member 4 in relation to the block set of rows 20 and 32 thereon, for example. By this arrangement, there is provided an automatic and accurate predetermined selection of apertures in the overlay member 4 so that the outermost blank row 24 thereof may be superimposed over, and in vertically spaced alignment with the next successive row of the block section 68 on the primary data storage member 2 upon which informational data is to be recorded. Such spatial correlation between the apertures in the overlay member 4 and the storage member 2 in relation to the lateral spacing between vertically extending columns in the respective block row sections insures accurate automatic recordation in respect to the transfer of informational data from the overlay member 4 to the primary storage data member 2 and hence, to the secondary storage member 8, whenever the appropriate horizontal row is selected.

In the invention, a rental receipt form (not shown) having transfer media on the bottom surface thereof may be employed in instances when request for the same is made by a tenant. In such case, the rental receipt form is of the same size as the overlay member 4 and has a corresponding outermost row inserted immediately beneath the overlay member 4 to provide a receipt for the tenant of the transaction. Thus, entries on row 24 of the overlay member 4 are recorded on the receipt, and by virtue of the transfer media on the primary data member 2 and the secondary member 8 as well.

As best seen in FIG. 1, the primary data member 2 is of a polygonal single-sheet construction adapted to be disposed in underlying transfer relation in respect to the underside of the overlay member 4. Preferably, this data member is employed to record all activity relating to a given tenant by use of the novel overlay system. As noted, the secondary storage member 2 contains an upper block set 40 having a plurality of lines forming a plurality of vertically extending columns at a plurality of horizontally extending parallel rows to form a series of blocks for recording changes to appear in lines 22 and 38 on the next month's overlay. This upper section is completed by overlay of the outermost bottom row 36 of the bottom block set 32 of the overlay member 4, over the next lower row of set 40 and transcribing as aforesaid.

The lower section 68 is employed to record the transactions for the period shown on the overlay member. This lower section 68 is completed simultaneously with the outermost row 24 of upper block set 20 of the overlay member 4, as aforesaid. Hence, in the invention, preferably no transaction is recorded directly on the face of the data member 2, but in accordance with the invention, the overlay member 4 is always employed for automatic recordation of the informational data and for simultaneously providing a record for input to the computer. The data members are filed in suite number sequenc.

In the invention, the secondary storage member 8, in the form of a deposit ticket may be of a two-part construction which is completed simultaneously with the overlay member 4, and the primary member 2 and is disposed in underlying relation beneath the primary member 2 for movable correlation with respect thereto, as seen in FIG. 1. As seen in FIG. 2, the two-part construction includes an upper sheet 80 and a lower sheet 82 which are unattached at one edge, as at 84, FIG. 1, and are integrally attached at the opposite edge by a tear strip, as at 86, provided by a perforated line 88. In this form, the sheets are disposed in superimposed relation and include a row of vertically spaced apertures 90 having the same spacing as the apertures 66 and 69 in the overlay 4 and storage member 2, as aforesaid. The sheets 80 and 82 are preferably of identical construction having a plurality of vertically extending columns, such as 92, 94, 95, 96 and 97, adapted for underlying laterally spaced correlation with the vertical columns, as at 74, on the primary member 2, and with the corresponding rows of the block sets 20 and 32 on the overlay member 4. Accordingly, such as security received, rent received, apartment number and last name of the tenant recorded on the upper row 24 (FIG. 3) of the overlay member 4 will be automatically transferred to the corresponding underlying row on the primary data member 2 immediately below the row 24 and simultaneously onto the corresponding columns (e.g., 94, 95, 96 and 97, etc.) of the secondary storage member 8 in a single operation. As shown, the member 8 is disposed in laterally offset relation in respect to the superimposed members 2 and 4, so that the outermost column, as at 100, adjacent the strip 86 is exposed for computing a transaction, such as the total amount of deposits, and for providing visual alignment of the rows of the secondary data storage member with the rows of the primary data storage member. Preferably, the upper sheet 80 is employed as a back-up and may be sent to the bank, for example, in relation to the normal bank deposit slip. The second sheet 82 may be retained as a permanent receipt record. For continuous operation, any number of secondary members 8 may be employed, dependent upon the number of transactions to be entered in a given period.

In the invention, the base member 10 for correlating in spatial relation the members 2, 4 and 8, is preferably of a polygonal, such as square, rectangular, etc., configuration having oppositely disposed end edges 106 and 108 which are disposed in general parallel relationship with respect to the edges 12 and 14 of the member 4 which, in turn, are coextensive with corresponding end edges 110 and 112 on the member 2 and also in relation to the edges 84 and 88 of the member. Similarly, generally parallel oppositely disposed top 114 and bottom 116 edges are provided which extend parallel to the corresponding top and bottom edges of the members 2, 4 and 8, as shown. The base member 10 is of a generally flat, rigid construction having a pair of oppositely disposed parallel recessed slots, as at 120 and 122, FIG. 2, of generally inverted T-shaped configuration adapted to receive elongated generally flat guide rails 124 and 126. Each of the rails 124 and 126 includes a plurality of integral, upstanding, vertically spaced, (FIG. 1) pins 128 and 130 having generally rounded terminal ends for registered insertion through the corresponding aperture rows 66, 69 and 90 provided in the respective members 2, 4 and 8. In the invention, the respective slots 120 and 122 are of generally complemental-shaped configuration in respect to the rails 124 and 126 with a slide-type clearance being provided to facilitate sliding adjustment of the rail members 124 and 126 relative to one another, as illustrated in FIG. 1. By this arrangement, the overlay member 4 may be readily disposed in engaged relation over the pins 128 via apertures 66, and hence in registration with the underlying horizontal row on the primary storage member 2 which, in turn, is accurately registered via the pins 128 and apertures 69 so that the registered members 2 and 4 may be selectively movable, as a unit, relative to the secondary storage member 8 affixed via its corresponding apertures 90 to the other pins 130 of the base 10. Conversely, the members 2 and 4 may be held stationary while the member 8 is slidably adjusted with respect thereto, as desired.

The component form parts of the system, such as members 2, 4 and 8, are preferably comprised of NCR (e.g., carbonless paper) to obviate the need for the use of a carbon. Hence, the user need merely press firmly onto the uppermost surface of a component to record a transaction on all components of the system.

Since each vertical line defining a column on the overlay member 4 is laterally spaced from the registration apertures 66 the same distance that each vertical line defining a corresponding column of the primary data storage member 2 is spaced from apertures 69, and since the rows are of equal height it can be seen that registration of the holes on the pins of the base member automatically result in proper overlying alignment of the columns as soon as the registration takes place. Similarly, the vertical lines forming the columns of the secondary data storage member 8 are spaced a predetermined distance from the apertures 90, and the spacing between the rows of pins of the primary and secondary registration means 170 and 172 is such that registration of the secondary storage member on the registration means 172 automatically aligns corresponding columns thereof in underlying relationship to corresponding columns of the primary data storage member 2 and overlay member 4 when the latter is placed thereover. As a result the transcription on an overlaying member is automatically passed through to an underlying member by such transfer media when data is transcribed on the outer row 24 of the overlay member 4. For purposes of ready visible comparison, each of the aforesaid corresponding columns contains correlating designation idicia of the information transcribed or to be transcribed therein, such as the term "base rent" as seen in row 136 of the primary storage member 2 and in row 21 of the overlay member 4.

OPERATION

At the beginning of each cycle of the closed loop operation the computer (not shown) prints information, including any modifications due to feedback from the last period, on the respective intermediate upper 22 and intermediate lower 38 rows of the overlay members 4. The overlay members 4 are forwarded to the manager of the particular building or buildings for use in the next month. At the start of each day in which transactions occur, the manager places the secondary storage member 8, a deposit ticket, on the base member 10 with the apertures 90 registering with the pins 130 of the secondary registration means 172 of the base member. For example, when the manager receives a payment from a tenant, the manager selects the primary data storage member 2, in the form of the tenant ledger applicable to that particular tenant, from the file and places it in partial overlayment on the secondary data storage member 8, as in FIG. 1, with the apertures 69 of the primary data storage member 2 in registration with the pins 128 of the primary registration means 170 of the base member 10. The next row, such as row 154, of the primary data member 2 on which information is to be recorded (the next lowest blank row) is laterally aligned with the next blank row 160 of the secondary data storage member 8 on which information is to be recorded. This may be accomplished by slidably vertically adjusting the registration means 170 and 172.

The overlay member 4 is then placed in overlaying relationship on the primary data storage member 2, with the registration of the holes 66 with the pins 128 being selected so that the top row 24 of the overlay member 4 is superimposed over, and thus covering, the next free row 154 of the primary data storage member 2 and the next free row 160 of the secondary data storage member 8. Because of the predetermined lateral spacing of the columns of the overlay member 4 and the primary data storage member 2, from their respective registration apertures 66 and 69, the columns having the correlation indicia of row 21 (FIG. 3) of the overlay member 4 are in alignment with the columns of row 136 (FIG. 1) of the primary data storage member 2 having the same correlation indicia, such as, for example, base rent. Because of the predetermined spacing between the registration means 170 and 172 of the base member 10, and the predetermined spacing of the columns of the secondary data storage member 8 from its apertures 90, and the aforesaid predetermined lateral spacing between the columns of the primary data storage member 2 and its registration apertures 69, the columns having the correlation indicia of row 136 of the primary data storage member 2 are in alignment with the columns having the same correlation indicia as those in row 162 of the secondary data storage member 2.

Figure 4:
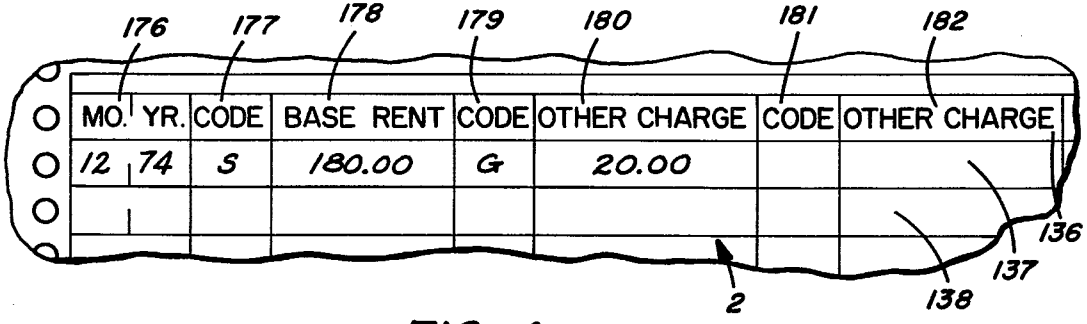
FIG. 4 is a fragmentary illustrative view of the lower set of rows of the primary data storage member illustrating such member having an entry thereon from a previous period, before the next entry is made.
Figure 5:
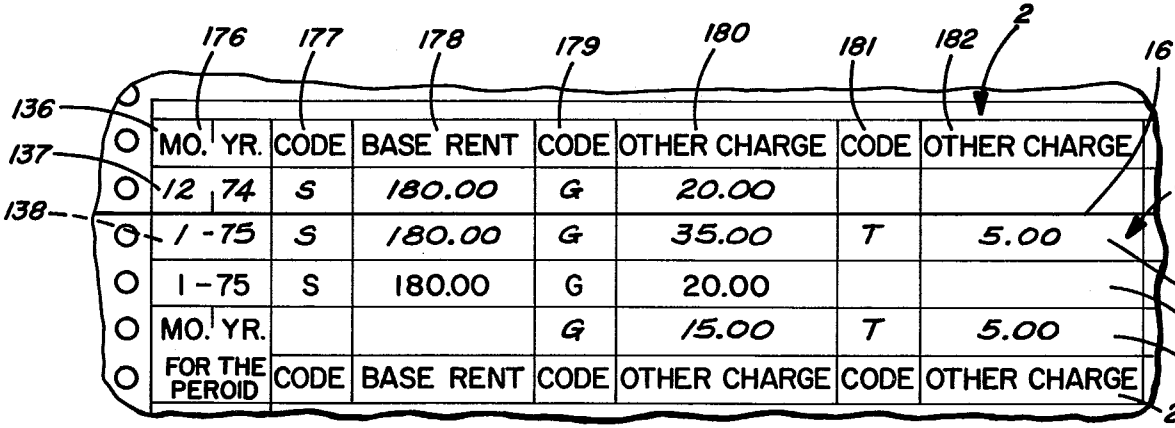
FIG. 5 is an illustrative fragmentary view of the primary data storage member with the overlay member in position after adding an entry from the next period, with the changes entered on the second inner row for use in up dating the computer.
Figure 6:
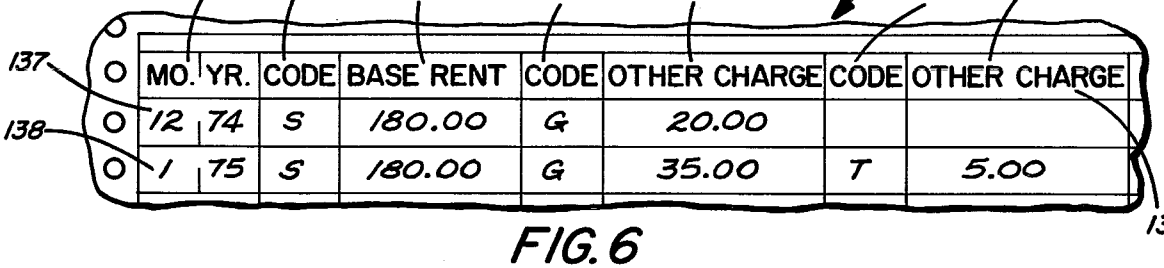
FIG. 6 is an illustrative fragmentary illustrative view of the lower set of rows of the primary data storage member after the next entry has been made in the lower set, and the overlay member removed.

FIGS. 4–6 illustrate a hypothetical example of how the rows 137 and 138 of the secondary data storage member might have been recorded in accordance with the present invention. FIG. 4 illustrates such primary data storage member 2 with an entry on the primary data storage member made on line 137 during the next previous recording period. FIG. 5 illustrates a portion of the primary data storage member 2 with the overlay 4 placed thereon so that the outermost upper row 24 of the overlay 4 covers the next available line 138 of the primary data storage member 2. The date for the period is copied from inner row 22 column 176 onto outer row 24 of column 176. Since such date is immediately below the date in the row 137 column 176 of the secondary data storage member 2, the manager has a cross-check to be sure he is using the overlay for the correct period. Since the base rent remained unchanged, the code S and the base rent of $180.00 are transcribed without change in column 178 of row 24. The tenant, however, decided since the last period, to rent additional garage space. The charge for additional garage space is $15.00. Therefore, the manager enters the code G in column 179 and the total garage rent $35.00 in column 180 of outermost row 24, computes the difference between such amount and the computerized amount of $20.00 from the computer printout on line 22 and enters such difference, $15.00 in the same column 180, in line 30. Because of such vertical alignment of columns, the speed and accuracy of the transcription is increased.

The tenant also incurred a telephone answering charge of $5.00 which is to be incurred in that month only. There had been no previous charge of any kind for such item in the last month, therefore, the manager selects the first lateral blank "other charge" column, columns 181 and 182, in row 24, enters the code T in column 181 and the charge of $5.00 in column 182. Since this is an item not appearing on the intermediary row 22, he adds the full $5.00 in column 182 on line 30 since the full amount is the difference between outer row 24 and row 22, which is zero.

The manager also makes entries in the remainder of the outer row 24, some of which would not be items which can be preprinted, such as, for example, the amount of money the manager will actually receive from the tenant. For example, such an item would be entered in row 24 column 48. Such column 48 is disposed sufficiently remote from the registration apertures 66 that such column is overlaying the secondary data storage member 8 as well as the primary data storage member 2. Thus an entry transcribed in such column is automatically transcribed by the transfer means on the correct block in the underlying primary data storage member 2 and secondary data storage member 8. Since the secondary data storage member 8 may receive such entries of the amount actually received from a plurality of tenants in a given day, it is useful that the deposit ticket 8 also has on it the identification of the tenant and suite for which the money is received. Such item is preprinted on the intermediate row 22 at columns 95 and 97 so that the manager may accurately copy the information on row 24 so that the amount entered on the secondary data member 8, the deposit ticket, is properly identified with the tenant who made the deposit.

Figure 7:
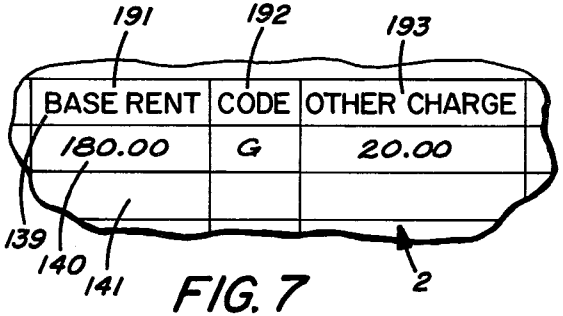
FIG. 7 is a fragmentary illustrative view of the upper set of rows of the primary data storage member illustrating such member having an entry thereon from the last change in the upper set of the primary data storage member.
Figure 8:
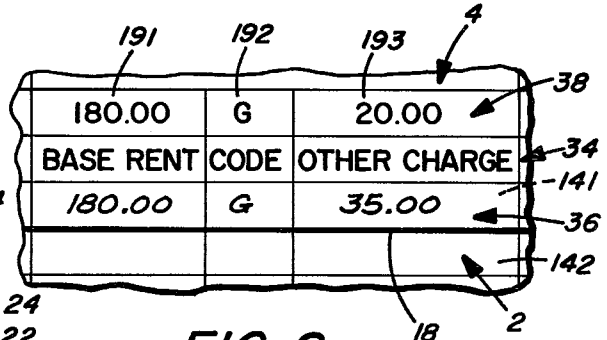
FIG. 8 is a fragmentary illustrative view of a portion of the upper set of rows of the primary data storage member with the overlay member in position after adding a new change in the upper set of the primary data storage member; and by transcription on the bottom row of the overlay.
Figure 9:
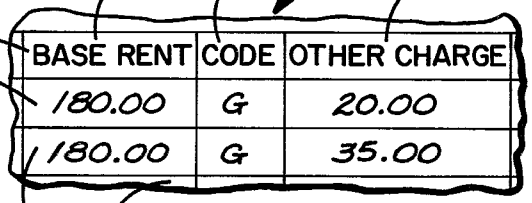
FIG. 9 is a fragmentary view of a portion of the upper set of rows of the primary data storage member after the next entry has been made in the upper set and the overlay member removed.

Having completed the entries on upper row 24, he now determines whether any of such entries are charges which will reoccur in the next time period. If so, he then locates the next free row 141 (FIG. 7) in the upper set of rows of the primary data storage member 2, and superimposes the bottom row 36 of the overlay member 4 over such free row 141 (FIG. 8). Entries made on row 36 will not only be transcribed onto a row of the upper set of rows of the primary data storage member 2 so that a record is made of those charges which will reoccur, but it will also be available for use in updating the computer for printing the information in lines 22 and 38 of the overlay member 4 for the next period of time, i.e. in the example, for the next month. Since the base rent remained unchanged, but should be printed on the next month's overlay, such amount, $180.00, is entered in column 191 of row 36 (FIG. 8). Since a garage payment will be contained on the next month's overlay, even though the amount is changed, an entry is made in columns 192 and 193 of row 36 of an amount for the garage, with the amount being the new amount, $35.00. Since the telephone answering service charge of $5.00 was an item only for the month of the current overlay 4, the month January, an entry is not made of such amount in row 36 since such item is not to appear on the next month's overlay member.

At the end of the day of the transactions, the deposit ticket 8 may be deposited in the bank, with a copy kept for the permanent records. Each tenant ledger, primary data storage member 2 is returned to the files for withdrawal at the next transaction involving such tenant.

If a transaction occurs between periods, then a blank overlay member 4 (not shown) with row 22 blank is filled out in the same manner that the blank column 181 (FIG. 5) was completed. Thus, the system is sufficiently flexible to allow for events occurring between the periodic monthly receipt of the overlay members 4 by the manager.

The manager at the end of the period transmits the overlay members 4 back to the central facility. The computer is programmed in a suitable manner known in the art to receive coded informational input, and make more than one printout based on such information, with the information being allocated to a particular printout by the format selected by the operator. As is conventional with computers, the computer can be programmed as is well known in the computer programming art, to store the information contained on the previous printouts, and as is further well known, the computer can be updated by inputs so that a portion of the stored information can be modified so that the next printout includes both the modified and unmodified information.

The operator, on receipt of the overlay member from the last period, which contain the transcriptions of the manager, keys a record, such as a card or a magnetic tape by preselected formats coded to identify the row, and the lateral location in the row, of the overlay 4, from which the informational data units to be fed to the computer are obtained.

The computer is programmed, so that upon receipt of an input coded for a column of row 30, it combines such input with the previously stored information from row 22 applicable to such column to produce a printout of the portion of row 24 which is disposed above row 30 so that such printout reproduces the entries as they were actually made on the primary data storage member 2. The operator then merely codes the computer for the entries on row 30, and the computer thereby updates its records as to that portion of row 24 which is disposed above row 30.

Figure 10:
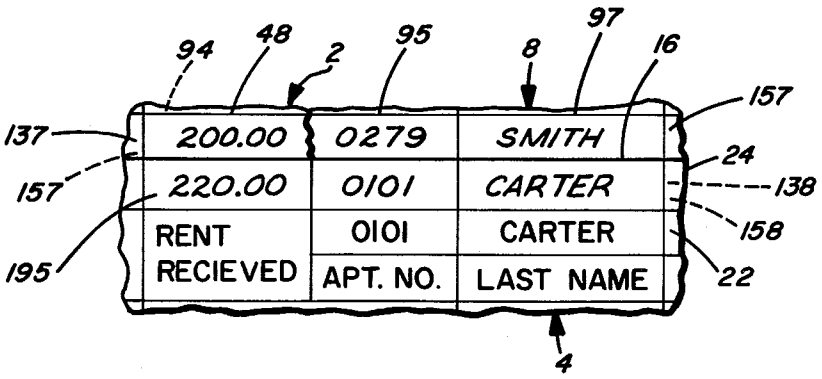
FIG. 10 is a fragmentary partly broken away illustrative view of a portion of the lower set of rows of the primary data storage member 2 and of the secondary data storage member 8 with the overlay member in overlapping data transfer position over the other two members.

The computer is also programmed, upon receipt of another input code, to printout new informational data units, for record keeping purposes of the actual information. Such new informational data units would be, for example, the entries made in row 24 which were not contained in the printout of overlay member 4, such as, for example, rent received. The operator, by appropriate code would enter such items on the computer input and the computer, in its printout would include such items. By the foregoing arrangement, the computer printout for transactions occurring in the period of the time appearing on the overlay member 4 would be an accurate record of the transactions as they appear on the selected row of the primary data storage member 2, such as block 195 of row 138 (FIG. 10). The printout of the transactions recorded on the primary data storage member is then available as a duplicate in the central office and as a means of cross-checking the accuracy of the system.

Having completed the operations for keying the computer to reproduce the current transactions as they actually appeared on the primary data storage member 2, the operator then uses a preselected format to key the computer so that the overlay member 4 for the next period of time will have the updated information applicable to such period. This is done by a code to indicate that the information being supplied to the computer is taken from row 36 of the previous overlay and to indicate the particular column in the row from which the information is taken. The computer is programmed upon receipt of such code to vary the printout on rows 22 and 38 accordingly. The operator merely uses the appropriate code in keying the computer and such information from row 36 in then available for the next printout of the overlay member 4. By such arrangement, the printout of the overlay member for the next period of time is updated based on changes from the previous period which will carry over to the next period.

It can be seen that by the foregoing system a novel apparatus and method is provided for a combined manual and computerized record keeping system for maximizing both accuracy, speed and efficiency of record keeping.

I claim:

1. A closed-loop feed back system of double checking, updating and accurately recording of data between a central location and a remote location comprising the steps of:

at a central location taking a first, overlay member with at least one edge defining a horizontal edge and with one face thereof having an outer row and an inner row generally parallel to said horizontal edge, machine printing humanly readable information on at least one predetermined laterally horizontal position of said inner row and in vertical alignment with a blank portion of said outer row, transmitting said overlay member to a remote location, at said remote location superimposing said overlay member at a laterally horizontally predetermined and vertically selected position on a primary data storage member whereby said blank portion of the overlay member is superimposed over a partially predetermined and partially blank portion of said primary data storage member with transfer means disposed between the blank portion of said face of the overlay member and the top surface of the primary data storage member, entering information related to said first mentioned information in said blank portion of the outer row of the overlay member whereby said second mentioned information is automatically transferred to the said blank portion of the primary data storage member, transmitting the overlay member back to the central location, at the central location taking a second overlay member and machine printing in humanly readable form the information from the outer row of the first overlay member on the inner row of said second overlay member at the laterally horizontal position corresponding to the laterally horizontal position of the information on the outer row of the first overlay member, and transmitting said second overlay member to the remote location where it is processed corresponding to the processing at the remote location of the first overlay member.

2. A system in accordance with 1, wherein at the remote location the first information is compared to the second information before entry of the second information to determine whether there is any difference.

3. A system in accordance with claim 2, wherein if the first information and the second information are the same, the first mentioned information is copied on the blank of the outer row to become the second mentioned information.

4. A system in accordance with claim 3, wherein at the remote location the first mentioned information is visually compared to the second information to verify identity.

5. A system in accordance with claim 1, wherein the overlays have a third row disposed inwardly of the first mentioned inner row wherein any difference between the outer row and the first mentioned inner row is entered in the third inner row at a location in vertical alignment with said first and second mentioned information.

6. A system in accordance with claim 1, including machine printing humanly readable information in vertical alignment with the said portions indicative of the kind of information in the aforesaid portions.

7. A system in accordance with claim 1, wherein said overlay member has upper and lower horizontal edges with said first mentioned outer row adjacent said upper horizontal edge and a second outer row adjacent said lower horizontal edge, with inner rows inward of each outer row, said primary data storage member has upper and lower edges wherein the second mentioned outer row of the overlay member is selectively superimposed towards the upper edge of the primary data storage member in a horizontally laterally predetermined and vertically selected position and the first mentioned outer row is selectively superimposed towards the lower edge of the primary data member in a horizontally laterally predetermined and vertically selected position.

* * * * *